US009493026B2

(12) United States Patent
Warmus

(10) Patent No.: US 9,493,026 B2
(45) Date of Patent: Nov. 15, 2016

(54) BINDER APPARATUS

(71) Applicant: R.R. DONNELLEY & SONS COMPANY, Chicago, IL (US)

(72) Inventor: James Warmus, La Grange, IL (US)

(73) Assignee: R.R. DONNELLEY & SONS COMPANY, Chicago, IL (US)

( * ) Notice: Subject to any disclaimer, the term of this patent is extended or adjusted under 35 U.S.C. 154(b) by 451 days.

(21) Appl. No.: 14/158,450

(22) Filed: Jan. 17, 2014

(65) Prior Publication Data

US 2014/0205361 A1 Jul. 24, 2014

Related U.S. Application Data

(60) Provisional application No. 61/756,340, filed on Jan. 24, 2013.

(51) Int. Cl.

| | |
|---|---|
| ***B42F 13/16*** | (2006.01) |
| ***B42F 13/20*** | (2006.01) |
| ***B42F 13/24*** | (2006.01) |
| ***B42F 13/26*** | (2006.01) |

(52) U.S. Cl.

CPC ..... *B42F 13/26* (2013.01); *B42F 13/16* (2013.01); *B42F 13/20* (2013.01); *B42F 13/24* (2013.01)

(58) Field of Classification Search

CPC ..... B42F 13/16; B42F 13/20; B42F 13/24; B42F 13/26

USPC ..... 402/38, 41

See application file for complete search history.

(56) References Cited

U.S. PATENT DOCUMENTS

| | | | | |
|---|---|---|---|---|
| 8,480,326 | B1 * | 7/2013 | Wong | B42F 13/26 402/38 |
| 2007/0274769 | A1 * | 11/2007 | Shimada | B42F 13/26 402/41 |
| 2008/0095572 | A1 * | 4/2008 | Frankeny | B42F 13/24 402/38 |
| 2009/0041532 | A1 * | 2/2009 | Cheng | B42F 13/26 402/38 |

FOREIGN PATENT DOCUMENTS

| | | | | |
|---|---|---|---|---|
| GB | 451406 A | * | 8/1936 | B42F 13/18 |

* cited by examiner

*Primary Examiner* — Kyle Grabowski
(74) *Attorney, Agent, or Firm* — Hanley, Flight & Zimmerman, LLC

(57) ABSTRACT

Binder apparatus are disclosed. An example binder apparatus includes a housing, first and second carrier rails supported by the housing and a slider comprising slots or protrusions. The slider is movable between a first position and a second position, where (a) in the first position, the slider to secure the first and second carrier rails in a closed position, in the second position, and (b) the slider to enable pivotable movement of the first and second carrier rails. The binder apparatus also includes a lever including a groove and gear teeth. The groove is to receive ends of the first and second carrier rails to pivot the carrier rails between the closed position and an open position. The gear teeth are to matingly engage the slots or protrusions to transition the slider between the first position and the second position.

16 Claims, 3 Drawing Sheets

Lever with teeth
Slots for engagement with lever
Rails, top view
Locked position (tabs block rails)
Transition
Open position (tabs within rail holes)
Blocking mechanism, top view Rails, top view Locked position (tabs block rails)

Transition

Open position (tabs within rail holes)

Blocking mechanism, top view

Lever with teeth
Slots for engagement with lever
701
702
703
704
706
708
710
712
716
801
802
803
304
805
806
808
810
812
814
816
818
820
822
824
902
906
908
910
1102

BINDER APPARATUS

RELATED APPLICATION

This patent claims priority to U.S. Provisional Patent Application No. 61/756,340, filed Jan. 24, 2013, which is hereby incorporated herein by reference in its entirety.

FIELD OF THE DISCLOSURE

This patent relates to binders and, more specifically, to binder apparatus.

BACKGROUND

Binders are used to store loose leaf pages, documents, other materials, etc.

DETAILED DESCRIPTION

Figure 1:
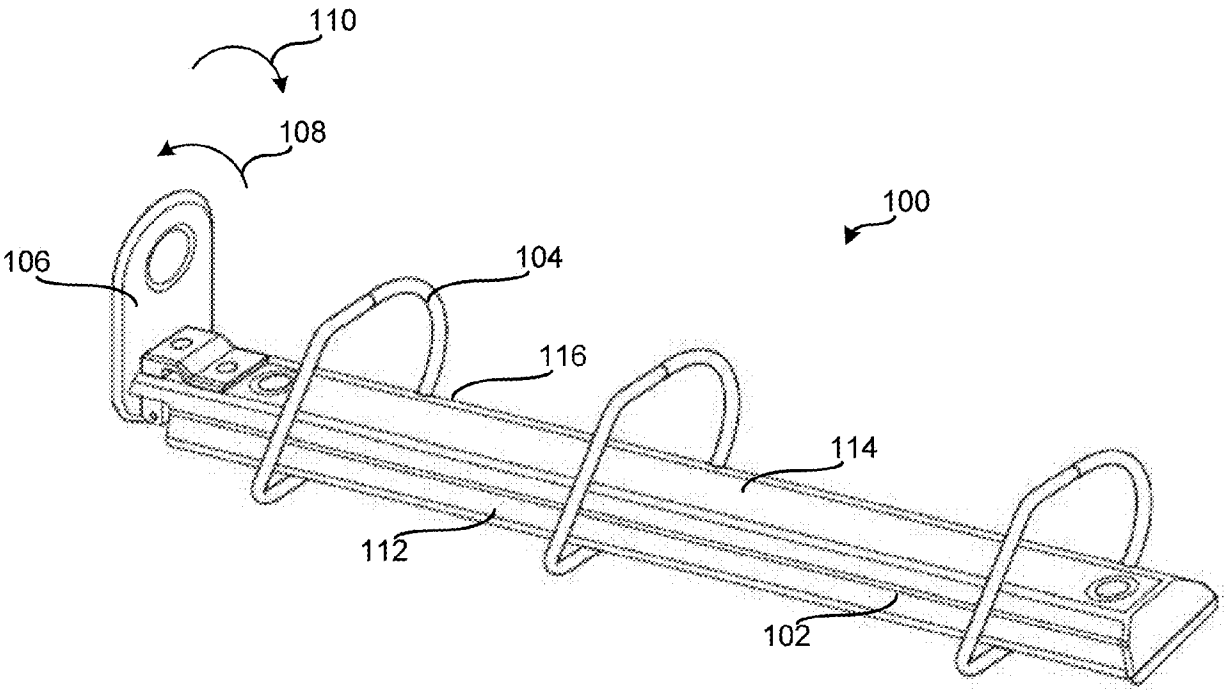
FIG. 1 depicts an example binder in accordance with the teachings of this disclosure.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The examples disclosed herein relate to binder apparatus that enable closure members/rings to be relatively easily transitioned and/or secured in either an open position or a closed position. More specifically, the examples disclosed herein relate to example travel bars and/or levers that enable a lever to pivot and transition carrier rails from the open position to the closed position prior to moving a travel bar. The travel bar is used to lock and/or secure the binder apparatus in the closed position and/or unlock and/or enable the binder apparatus to move toward and be in the open position. In contrast to some known examples, the example binder apparatus may not include an intermediate connector (s) between the lever and the travel bar to enable travel bar movement delay. In some examples, to move the travel bar between the locked and unlocked positions, the lever includes teeth (e.g., a pinion) that mesh with teeth (e.g., a rack) of the travel bar. To enable travel bar movement delay, the lever includes portions without such teeth.

In operation, when the lever begins to transition the rings from the closed position to the open position, the lever teeth that are meshing with the travel bar teeth move the travel bar and/or its locking mechanism to unblock the movement of the carrier rails and enable the rings to open. In some examples, the non-toothed portions of the lever may be configured to enable the lever to transition the carrier rails from the fully open position toward the fully closed position prior to the travel bar being moved (e.g., the teeth of the lever are not engaged with the teeth of the travel bar). Specifically, the lever may be moved from the fully open position toward the closed position a substantial distance prior to the lever teeth engaging with and/or reengaging with the travel bar teeth. Moving the lever without moving the travel bar enables the carrier rails to be transitioned from the open position toward the closed and/or secured position prior to the travel bar moving, which substantially prevents the binder apparatus from malfunctioning (e.g., jamming, binding, etc.). In some examples, a spring and/or biasing apparatus is used to assist in moving the travel bar from the unsecured position toward and/or into the secured position. Additionally or alternatively, the spring may assist in positioning the travel bar teeth in a position where the lever teeth, moving from the open position toward the closed position, can reengage with and/or mesh with the travel bar teeth. The spring may be coupled between the binder housing and the travel bar or otherwise coupled to bias the travel bar.

The lever gears may be positioned above and/or below the pivot point of the lever. The pivot point may be differently positioned and/or the lever may have different shapes (e.g., circular, oblong, etc.) to change the movement of the travel bar relative to the movement of the carrier rails. In some such examples, the lever teeth may have different sizes and/or shapes to enable engagement to be maintained with the travel bar teeth as the lever is rotated between the open and/or closed positions.

FIG. 1 depicts an example binder apparatus 100 that may be used to store loose leaf pages, documents, other materials, etc. The binder 100 may include a housing 102, one or more associated closure members 104 and a lever or actuating assembly 106. To open and/or close the associated closure members 104, the lever assembly 106 may be actuated in a direction generally represented by arrows 108 and/or 110. Specifically, to open the associated closure members 104, the lever assembly 106 is moved in a direction generally represented by arrow 108 and, to close the associated closure members 104, the lever assembly 106 is moved in a direction generally represented by arrow 110. However, the lever assembly 106 may be differently configured to open and/or close the associated closure members 104.

Figures 2, 3, 4, 5, 6:
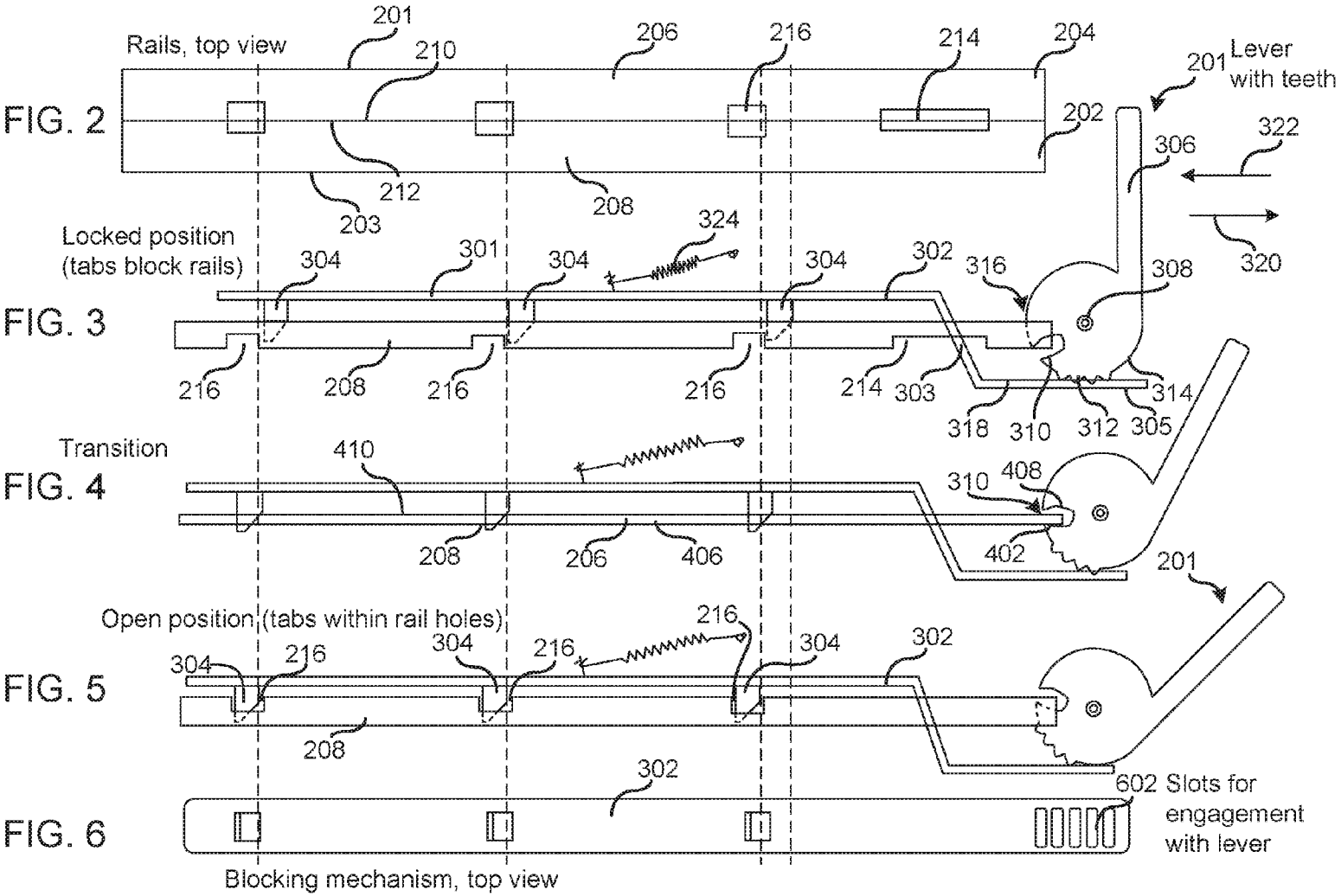
FIG. 2 depicts example carrier rails that can be used to implement the example binder of FIG. 1.
FIGS. 3-5 depict different positions of an example lever, an example travel bar and the example carrier rails of FIG. 2 that can be used to implement the example binder of FIG. 1.
FIG. 6 depicts the example travel bar of FIGS. 3-5 that can be used to implement the example binder of FIG. 1.

The housing 102 includes a first side and/or portion 112, a second and/or central portion 114 and a third side and/or portion 116. The second portion 114 is coupled to and positioned between the first and third sides 112, 116. Carrier rails 202, 204 (FIG. 2) and/or 702, 704 (FIG. 7) are positioned within the housing 102 such that a first longitudinal edge 201 (FIG. 2) and/or 701 (FIG. 7) of the first carrier rail 202, 702 is biased by the first side 112 and a second longitudinal edge 203 (FIG. 2) and/or 703 (FIG. 7) of the second carrier rail 204, 704 is biased by the third side 116. Third and fourth longitudinal edges 210, 212 (FIG. 2) and/or 710, 712 (FIG. 7) of the carrier rails 202, 204, 702, 704 may be pivotably coupled via one or more tabs, for example. To enable the binder 100 to be opened and closed, the binder 100 includes the lever 106, 201 and/or 701, a travel bar 302 (FIG. 3) and/or 802 (FIG. 8) and locking elements 304.

As shown in FIGS. 3-6, in some examples, the carrier rails 206, 208 define a slot and/or cutout 214 through which the travel bar 302 extends. In the illustrated example, the travel bar 302 includes a first portion 301, a second portion 303 and a third portion 305. The first portion 301 is positioned adjacent the housing 102 and inward facing surfaces of the carrier rails 206, 208, the second portion 303 extends through the slot 214 and the third portion 305 is positioned adjacent outward facing surfaces of the carrier rails 206, 208 such that the carrier rails 206, 208 are positioned between the housing 102 and the third portion 305.

In the example illustrated in FIGS. 2-6, the lever 201 includes a handle 306, a first aperture 308, a groove, a second aperture and/or beak 310, a first and/or toothed portion 312 and/or a second and/or non-toothed portion 314. A pin is received in the first aperture 308 and apertures of the housing 102 (FIG. 1) to pivotably couple the lever 201 to the housing 102. Ends 316 of the carrier rails 206, 208 are positioned in the beak 310 to enable movement of the handle 306 to in turn transition and/or assist in transitioning the carrier rails 206, 208 between the open and closed positions. A travel bar portion and/or end 318 having teeth and/or other structures 602 is positioned adjacent the toothed and/or non-toothed portions 312, 314.

In operation as shown in FIGS. 3-6, to open the binder 100, the handle 306 is moved in a direction generally indicated by the arrow 320, thereby moving a first end 402 of the beak 310 toward outward facing surfaces 406 of the carrier rails 206, 208. When the first end 402 begins to transition the carrier rails 206, 208 from the closed position to the open position, the teeth 602 of the travel bar end 318 are positioned adjacent to and/or intermeshed with the toothed portion 312 of the lever 201. As the handle 306 is further pivoted in the direction generally indicated by arrow 320, the travel bar 302 and its locking elements 304 are moved and/or transitioned toward an unblocking position (e.g., moved toward an end of the binder 100 opposite the lever 201). Specifically, the locking elements 304 are moved via the longitudinal movement of the travel bar 302 to position the locking elements 304 adjacent apertures 216 defined by the carrier rails 206, 208 to enable and/or not block the carrier rails 206, 208 from pivoting toward the open position.

To close the binder 100 as shown in FIGS. 3-6, the handle 306 is moved in a direction generally indicated by arrow 322, thereby moving a second end 408 of the beak 310 toward inward facing surfaces 410 of the carrier rails 206, 208. In some examples, the non-toothed portion 314 of the lever 201 has a length, arc and/or is sized to enable the second end 408 to engage and transition the carrier rails 206, 208 toward the closed position prior to the toothed portion 312 engaging and/or intermeshing with the teeth 602 of the travel bar end 318. After the toothed portion 312 engages the corresponding teeth 602 on the travel bar 302, further movement of the handle 306 in the direction generally indicated by arrow 322 moves and/or transitions the travel bar 302 and the locking elements 304 toward the blocking position (e.g., moved toward an end of the binder 100 adjacent the lever 201). Additionally or alternatively, in some examples, the travel bar 302 is biased via a spring and/or biasing apparatus 324 in a direction generally indicated by arrow 320 and/or 322. In the blocking position, the locking elements 304 may be positioned between the housing 102 and the carrier rails 206, 208 to prevent the carrier rails 206, 208 from pivoting and/or the binder 100 from opening.

As shown in FIGS. 8-11, in some examples, the travel bar 802 includes a first portion 801, a second portion 803 and a third portion 805. The first portion 801 is positioned closer to the carrier rails 706, 708 than the third portion 805 and the third portion 805 is positioned closer to the housing 102 than the first portion 801. The second portion 803 couples the first and third portions 801, 805.

In the example illustrated in FIGS. 7-11, the lever 701 includes a handle 806, a first aperture 808, a groove, a second aperture and/or beak 810, a first and/or toothed portion 812 and/or a second and/or non-toothed portion 814. A pin is received in the first aperture 808 and apertures of the housing 102 (FIG. 1) to pivotably couple the lever 701 to the housing 102. Ends 816 of the carrier rails 706, 708 are positioned in the beak 810 to enable movement of the handle 806 to in turn transition and/or assist in transitioning the carrier rails 706, 708 between the open and closed positions. A travel bar portion and/or end 818 having teeth and/or other structures 1102 is positioned adjacent the toothed and/or non-toothed portions 812, 814.

Figures 7, 8, 9, 10, 11:
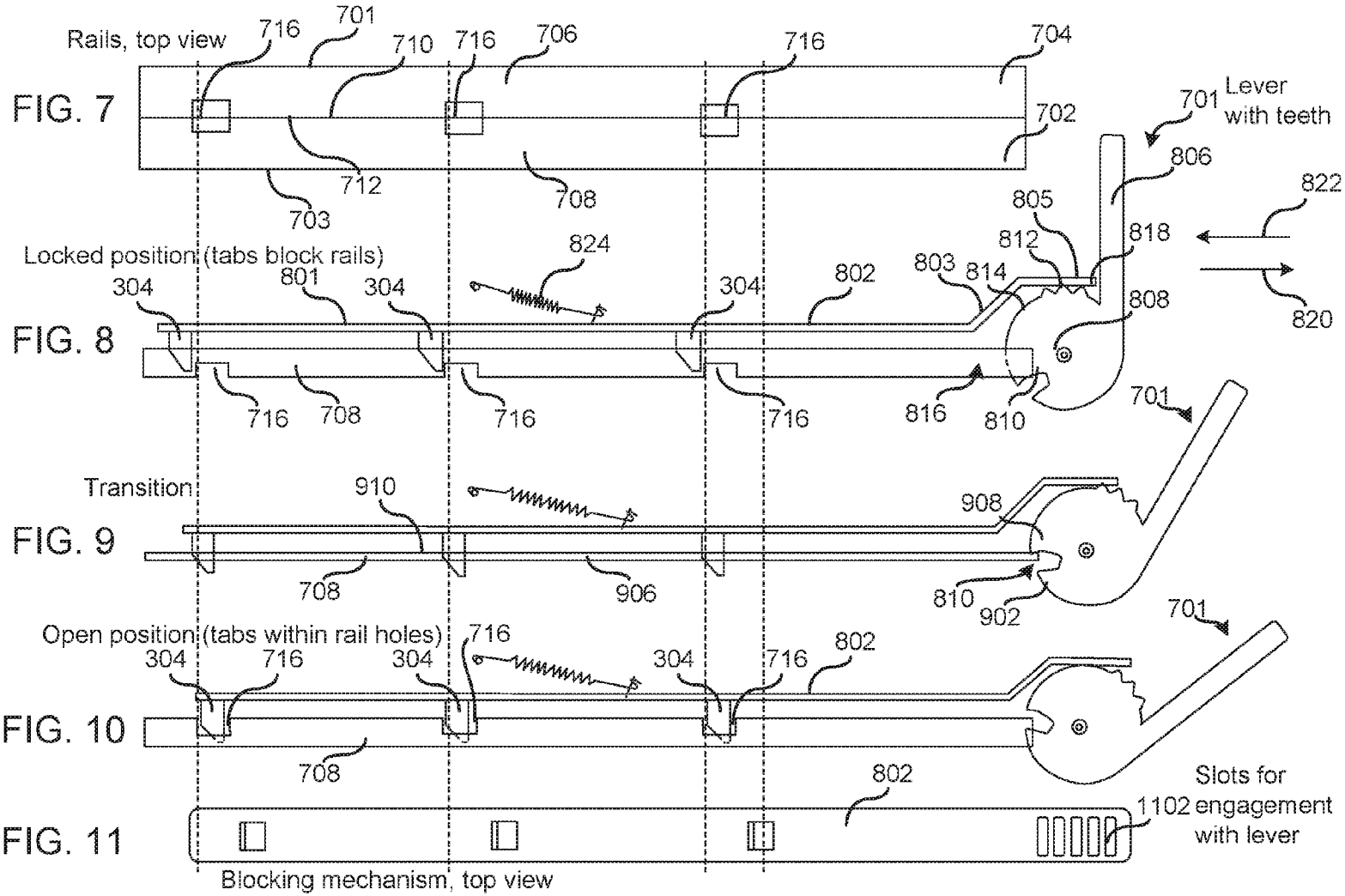
FIG. 7 depicts example carrier rails that can be used to implement the example binder of FIG. 1.
FIGS. 8-10 depict different positions of an example lever, an example travel bar and the example carrier rails of FIG. 7 that can be used to implement the example binder of FIG. 1.
FIG. 11 depicts the example travel bar of FIGS. 8-10 that can be used to implement the example binder of FIG. 1.

In operation as shown in FIGS. 8-10, to open the binder 100, the handle 806 is moved in a direction generally indicated by the arrow 820, thereby moving a first end 902 of the beak 810 toward outward facing surfaces 906 of the carrier rails 706, 708. When the first end 902 begins to transition the carrier rails 706, 708 from the closed position to the open position, the teeth 1102 of the travel bar end 818 are positioned adjacent to and/or intermeshed with the toothed portion 812 of the lever 701. As the handle 806 is further pivoted in the direction generally indicated by arrow 820, the travel bar 802 and its locking elements 304 are moved and/or transitioned toward an unblocking position (e.g., moved toward an end of the binder 100 adjacent the lever 701). Specifically, the locking elements 304 are moved via the longitudinal movement of the travel bar 802 to position the locking elements 304 adjacent apertures 716 defined by the carrier rails 706, 708 to enable and/or not block the carrier rails 706, 708 from pivoting toward the open position.

To close the binder 100 as shown in FIGS. 7-11, the handle 806 is moved in a direction generally indicated by arrow 822, thereby moving a second end 908 of the beak 810 toward inward facing surfaces 910 of the carrier rails 706, 708. In some examples, the non-toothed portion 814 of the lever 701 has a length, arc and/or is sized to enable the second end 908 of the beak 810 to engage and transition the carrier rails 706, 708 toward the closed position prior to the toothed portion 812 engaging and/or intermeshing with the teeth 1102 of the travel bar end 818. After the toothed portion 812 engages the corresponding teeth 1102 on the travel bar 302, further movement of the handle 806 in the direction generally indicated by arrow 822 moves and/or transitions the travel bar 802 and the locking elements 304 toward the blocking position (e.g., moved toward an end of the binder 100 opposite the lever 701). Additionally or alternatively, in some example, the travel bar 802 is biased via a spring and/or biasing apparatus 824 in a direction generally indicated by arrow 820 and/or 822. In the blocking position, the locking elements 304 may be positioned between the housing 102 and the carrier rails 706, 708 to prevent the carrier rails 706, 708 from pivoting and/or the binder 100 from opening.

The examples disclosed herein relate to binders including a lever having a geared mechanism to move a travel bar between a blocking position and a non-blocking position.

In some examples, teeth of the geared mechanism are positioned on a bottom surface of the lever. In such examples, in the closed position, the teeth of the lever are actively engaged with corresponding teeth of the travel bar and the blocking elements are aligned with a solid portion of (e.g., not an aperture) the binder carrier rails. As the lever is depressed (e.g., moved to open the binder), the lower beak of the lever engages and presses the carrier rails upward and the lever teeth/travel bar teeth engagement move the travel bar toward the non-blocking position.

In some examples, when the lever is fully depressed (e.g., the binder is fully open), the lever teeth do not actively engage the travel bar teeth and a biasing element urges the locking elements, via the travel bar, to be fully engaged in and/or adjacent to openings defined by the carrier rails. The blocking elements may remain adjacent the travel bar openings even though the biasing element is biasing the travel bar.

In some examples, because the lever teeth are not engaged with the travel bar teeth, initial movement of the lever to transition carrier rails from the fully open position to the closed position does not move the travel bar. As the lever is rotated prior to the lever teeth and the travel bar teeth engaging, in some examples, movement of the travel bar may be caused by the biasing element and the increase in space between the carrier rails and the binder housing as the carrier rails are pivoted toward the closed position. In some examples, once the lever teeth and the travel bar teeth engage, further movement of the lever in combination with the biasing element moves the travel bar toward the locked position. Additionally or alternatively, in some examples, as the lever is rotated prior to the lever teeth and the travel bar teeth engaging, the position of the travel bar may be maintained via an interaction between the apertures of the travel bar and the blocking elements.

In other examples, the lever teeth are positioned on the top of the lever. In such examples, when the binder is closed, the lever teeth are actively engaged with corresponding teeth/structures of the travel bar up until a transition point (e.g., FIGS. 4, 9). At the transition point, the lever teeth no longer engage and/or intermesh with the travel bar teeth to enable the travel bar to remain stationary and/or substantially not move as the lever begins to rotate and/or move from the open position toward the closed position. As the lever further rotates toward the closed position pivoting the carrier rails, a space and/or distance between a pivot axis of the carrier rails and an inner housing surface is increased. After sufficient space between the carrier rails and the inner housing surface is created, the lever teeth re-engage with the travel bar teeth to move the travel bar into the blocking position.

In any of the examples disclosed herein, the number, size and/or the position of lever teeth may be adjusted to change the timing and/or movement of the travel bar. In any of the examples disclosed herein, the travel bar may include a planar structure and/or a non-planar structure(s) (e.g., include steps, tapered surfaces, etc.). In any of the examples disclosed herein, the lever may include a circular/cylindrical portion, oblong/cylindrical portion, etc.

In examples in which the motion of the blocking travel bar includes a vertical component, the arc corresponding to the area may correspondingly deviate from a circular path to match the motion induced by the travel bar. In some examples, the blocking mechanism can be of any type known in the art, e.g., cavity filling between the rails and the housing, or blocking between the rails and tabs positioned on the bottom surface of the rails, or other.

Furthermore, although certain example methods, apparatus and articles of manufacture have been described herein, the scope of coverage of this patent is not limited thereto. On the contrary, this patent covers all methods, apparatus and articles of manufacture fairly falling under the doctrine of equivalents.

The invention claimed is:

1. A binder apparatus, comprising:

a housing;

first and second carrier rails supported by the housing;

a slider comprising slots or protrusions, the slider movable between a first position and a second position, where (a) in the first position, the slider to secure the first and second carrier rails in a closed position, and (b) in the second position, the slider to enable pivotable movement of the first and second carrier rails; and a lever comprising a groove and gear teeth, the groove to receive ends of the first and second carrier rails to pivot the carrier rails between the closed position and an open position, the gear teeth to matingly engage the slots or protrusions to transition the slider between the first position and the second position.

2. The binder apparatus of claim 1, wherein, when the lever initially pivots the first and second carrier rails from the open position toward the closed position, the gear teeth are not to matingly engage the slots or protrusions to delay the movement of the slider from the second position to the first position.

3. The binder apparatus of claim 1, further comprising ring portions coupled along the first and second carrier rails, in the closed position, respective ring portions engage to form a closure.

4. The binder apparatus of claim 1, further comprising a locking element coupled to the slider, in the closed position, the slider to position the locking element between the first and second carrier rails and the housing to secure the first and second carrier rails in the closed position.

5. The binder apparatus of claim 4, wherein in the open position, the slider to align the locking element with an aperture defined by one or more of the first carrier rail or the second carrier rail to enable the locking element to at least partially pass through the aperture and enable pivotable movement of the first and second carrier rails.

6. The binder apparatus of claim 1, wherein the slider is directly coupled to the lever.

7. The binder apparatus of claim 1, further comprising a biasing element coupled between the housing and the slider to urge the slider toward the first position.

8. The binder apparatus of claim 1, wherein at least some of the gear teeth of the lever are differently sized or shaped relative to each other to enable engagement to be maintained with the slots or protrusions.

9. The binder apparatus of claim 1, wherein the gear teeth of the lever comprises a first tooth of a first dimension and a second tooth of a second dimension different than the first dimension.

10. The binder apparatus of claim 9, wherein, in the closed position, the gear teeth to at least partially face away from an inner surface of the housing.

11. The binder apparatus of claim 9, wherein, in the closed position, the gear teeth to at least partially face toward an inner surface of the housing.

12. The binder apparatus of claim 1, wherein the slider comprises a first portion, a second portion, and a third portion, the first portion to be positioned between the housing and the first and second carrier rails, the first and second carrier rails to be at least partially positioned between the housing and the third portion.

13. The binder apparatus of claim 12, wherein the second portion extends through a slot defined by one or more of the first and second carrier rails, the second portion to couple the first and third portions.

14. The binder apparatus of claim 1, wherein the slider comprises a first portion, a second portion, and a third portion, the first portion being off-set from the third portion.

15. The binder apparatus of claim 14, wherein the first portion, the second portion, and the third portion are to be positioned between the housing and the first and second carrier rails.

16. The binder apparatus of claim 1, wherein the gear teeth are positioned away from the slots or protrusions when the lever initially pivots the first and second carrier rails from the open position to the closed position to delay movement of the slider away from the second position to the first position.

* * * * *